US008391751B2

(12) United States Patent
Kawai et al.

(10) Patent No.: US 8,391,751 B2
(45) Date of Patent: Mar. 5, 2013

(54) IMAGING UNIT AND IMAGE FORMATION APPARATUS PROVIDED WITH THE SAME

(75) Inventors: Masashi Kawai, Toyohashi (JP); Syuichi Katogi, Toyokawa (JP)

(73) Assignee: Konica Minolta Business Technologies, Inc., Chiyoda-Ku, Tokyo (JP)

( * ) Notice: Subject to any disclaimer, the term of this patent is extended or adjusted under 35 U.S.C. 154(b) by 260 days.

(21) Appl. No.: 12/871,153

(22) Filed: Aug. 30, 2010

(65) Prior Publication Data

US 2011/0052267 A1 Mar. 3, 2011

(30) Foreign Application Priority Data

Sep. 2, 2009 (JP) ..... 2009-202385

(51) Int. Cl.
*G03G 15/08* (2006.01)
*G03G 21/18* (2006.01)

(52) U.S. Cl. ..... 399/258; 399/113

(58) Field of Classification Search ..... 399/258, 399/113, 262, 119, 120
See application file for complete search history.

(56) References Cited

U.S. PATENT DOCUMENTS

| | | | | |
|---|---|---|---|---|
| 2003/0072590 | A1* | 4/2003 | Shimaoka et al. | 399/258 |
| 2005/0226658 | A1* | 10/2005 | Haruyama | 399/258 |
| 2006/0216063 | A1* | 9/2006 | Okoshi | 399/113 X |
| 2007/0196136 | A1 | 8/2007 | Yamamoto et al. | |
| 2008/0089718 | A1* | 4/2008 | Ishiguro et al. | 399/258 |
| 2008/0317507 | A1* | 12/2008 | Moon et al. | 399/258 X |
| 2009/0129822 | A1* | 5/2009 | Toh et al. | 399/258 |

FOREIGN PATENT DOCUMENTS

| | | | |
|---|---|---|---|
| CN | 101025592 | A | 8/2007 |
| JP | 2006-011233 | A | 1/2006 |
| JP | 2007-219417 | A | 8/2007 |

OTHER PUBLICATIONS

The First Office Action dated May 8, 2012, issued in corresponding Chinese Patent Application No. 201010271558.5, and an English Translation thereof. (10 pages).

* cited by examiner

*Primary Examiner* — Sophia S Chen
(74) *Attorney, Agent, or Firm* — Buchanan Ingersoll & Rooney PC

(57) ABSTRACT

In a single-body type imaging unit including a toner bottle provided with a drive shaft, and a print unit provided with a drive shaft, the toner bottle and the print unit are coupled to each other via an elastic member.

18 Claims, 14 Drawing Sheets

IMAGING UNIT AND IMAGE FORMATION APPARATUS PROVIDED WITH THE SAME

This application is based on application No. 2009-202385 filed in Japan on Sep. 2, 2009, the contents of which are hereby incorporated by reference.

The present invention relates to an imaging unit including a toner bottle and a print unit connected to each other so as to form a toner passage, and an image formation apparatus provided with the same.

BACKGROUND OF THE INVENTION

Conventionally, there is known an image formation apparatus to which an imaging unit including a toner bottle and a print unit is attached. The image formation apparatus has a structure in which a drive shaft is respectively provided in the toner bottle and the print unit, and drive force is obtained from a side of a main body of the image formation apparatus to which the imaging unit is attached.

As a coupling mode of the toner unit and the print unit of the imaging unit used in the image formation apparatus, there are a (single-body type) imaging unit in which the toner unit and the print unit are integrated so that the number of parts such as a shutter are reduced in order to reduce cost for introducing consumable goods for each time, and a (double-body type) imaging unit in which the toner bottle and the print unit are formed into separate bodies in order to reduce cost of the image formation apparatus over the entire use duration, and the toner bottle with the shorter life is replaceable (refer to Japanese Unexamined Patent Publication No. 2006-11233 and Japanese Unexamined Patent Publication No. 2007-219417). However, in general, the image formation apparatus is not designed so that the single-body type and double-body type imaging units can be attached to the image formation apparatus with compatibility. That is, an attached part on the side of the main body of the image formation apparatus is not commonly used so as to correspond to both the single-body type and double-body type imaging units.

There is a major advantage in the common use of the attached part on the side of the main body of the image formation apparatus. However, there are various problems in the common use.

For example, when the toner bottle and the print unit are respectively rigidly fixed, oscillation generated by the drive shaft of the toner bottle is transmitted to the print unit so as to generate color deviation. In a case of the double-body type imaging unit, since an elastic member is provided between the toner bottle and the print unit, the transmission of the oscillation from the toner bottle to the print unit can be relatively easily suppressed. However, in a case of the single-body type imaging unit, since the oscillation of the toner bottle is directly transmitted to the print unit, there is a need for connecting the attached part in the main body of the image formation apparatus provided with an elastic part for absorbing the oscillation and the drive shaft of the toner bottle. Therefore, the attached part in the main body of the image formation apparatus cannot be commonly used.

In a case of the single-body type imaging unit, the toner bottle and the print unit do not press against each other for positioning. However, in a case of the double-body type imaging unit, the toner bottle and the print unit sometimes press against each other. When the toner bottle and the print unit are fixed in such a way, the print unit is displaced so as to generate the color deviation. The generation of the color deviation is due to a difference in structures between the single-body type and double-body type imaging units. Therefore, unless the structures of the single-body type and double-body type imaging units are changed, the problem cannot be solved. Thus, without changing the structures of the imaging units, the attached part in the main body of the image formation apparatus cannot be commonly used so as to solve the above problem.

As a solution for the above problem, it is thought that looseness is provided for positioning the toner bottle relative to the main body of the image formation apparatus, and the drive force to the toner bottle is transmitted by flexible drive transmission means from the main body of the image formation apparatus. However, the number of parts is increased and the cost is boosted.

It is also thought that the pressing due to the oscillation and the positioning is solved by securely fixing the print unit to the main body. However, due to an increase in rigidity of the main body of the image formation apparatus, addition of fixing parts, and the like, the cost is boosted.

SUMMARY OF THE INVENTION

An imaging unit of the present invention is a single-body type imaging unit including a toner bottle provided with a drive shaft, and a print unit provided with a drive shaft, wherein the toner bottle and the print unit are coupled to each other via an elastic member.

Alternatively, an imaging unit of the present invention is a double-body type imaging unit including a toner bottle provided with a drive shaft, a print unit provided with a drive shaft, a toner bottle engagement portion provided in the toner bottle, and a print unit engagement portion provided in the print unit to be engaged with the toner bottle engagement portion, wherein an elastic member is interposed between the print unit and the print unit engagement portion, between the toner bottle and the toner bottle engagement portion, or between the print unit engagement portion and the toner bottle engagement portion, so that the toner bottle and the print unit is separably coupled to each other.

An image formation apparatus of the present invention includes an imaging unit including a toner bottle having a drive shaft, and a print unit having a drive shaft, and an attached portion to which the imaging unit is attached, wherein in a state that the toner bottle and the print unit are coupled to each other via an elastic member, the imaging unit is attached to the attached portion.

DETAILED DESCRIPTION OF THE PREFERRED EMBODIMENTS

Hereinafter, an embodiment of the present invention will be described with reference to the drawings.

Figure 1:
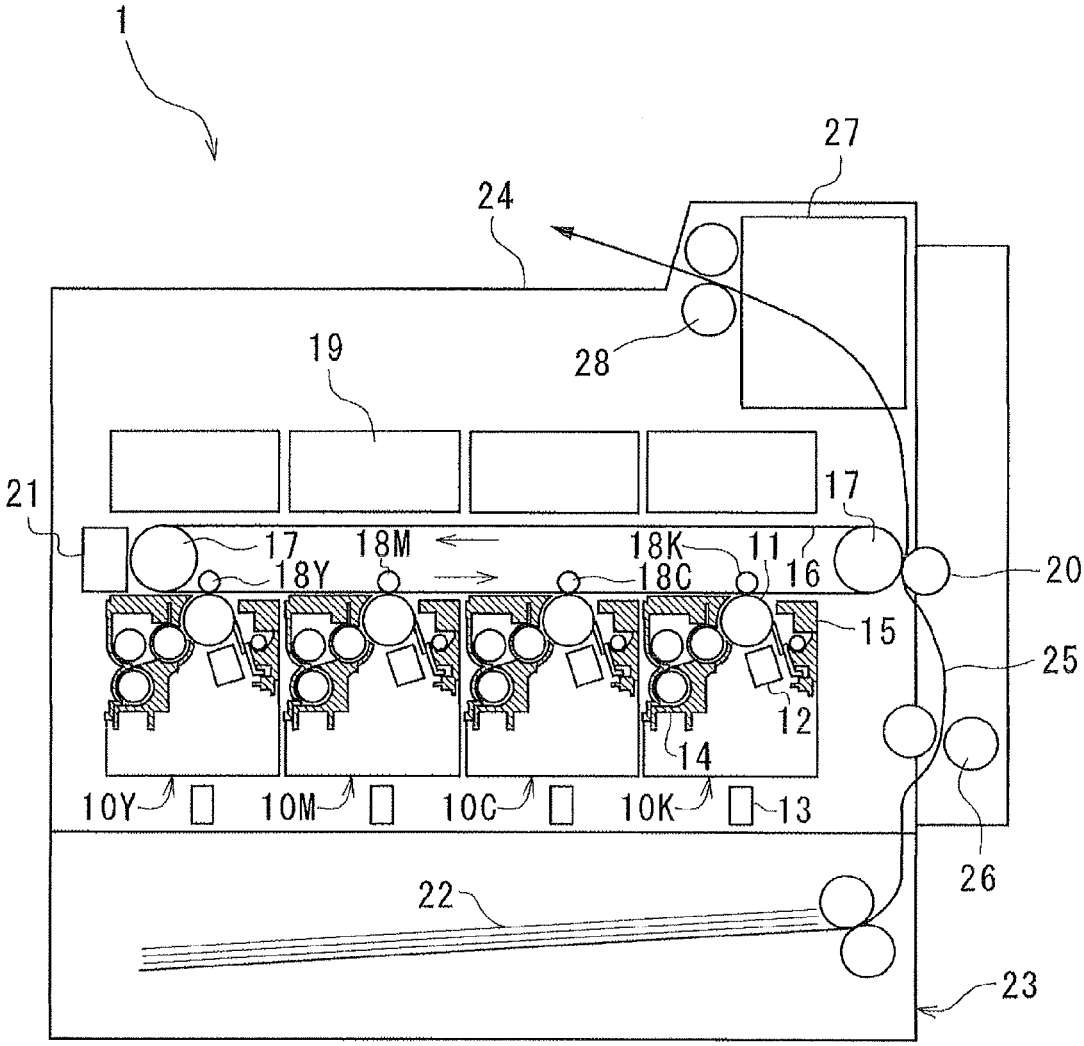
FIG. 1 is a schematic view showing an image formation apparatus.
Figure 2:
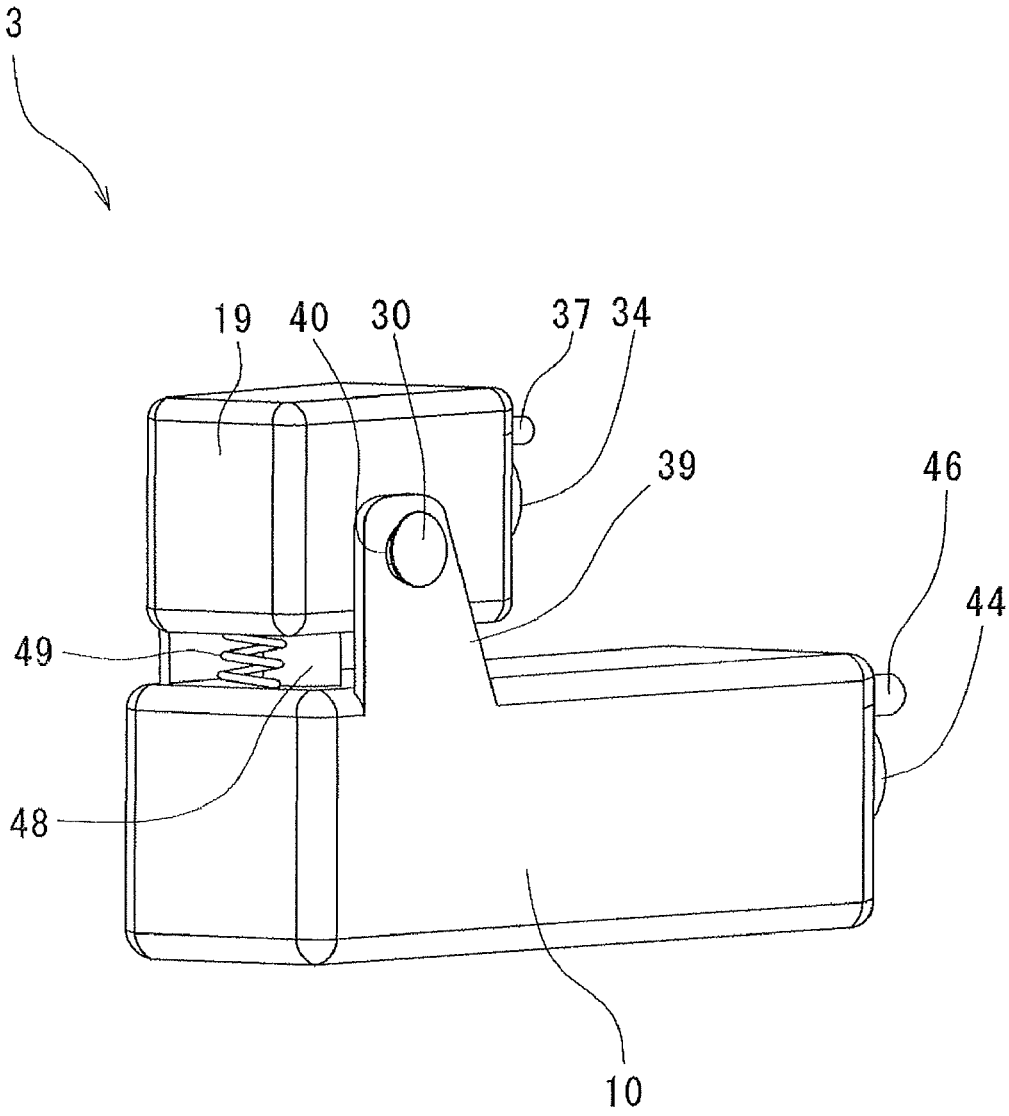
FIG. 2 is a view showing a single-body type imaging unit of the present invention.
Figure 3A:
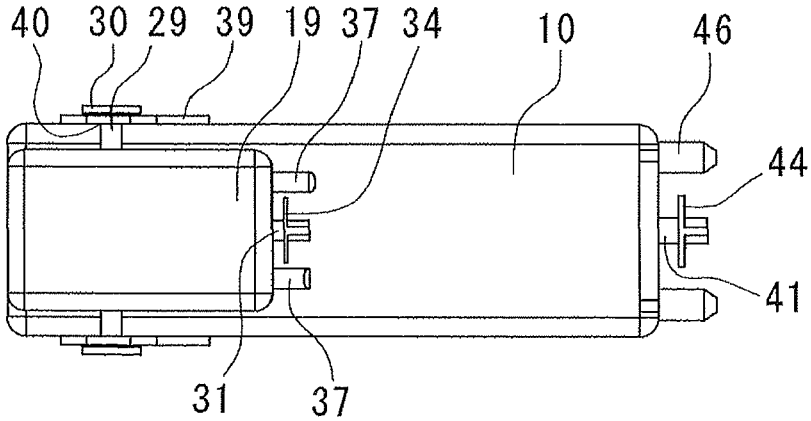
FIG. 3A is a top view of the single-body type imaging unit of the present invention.
Figure 3B:
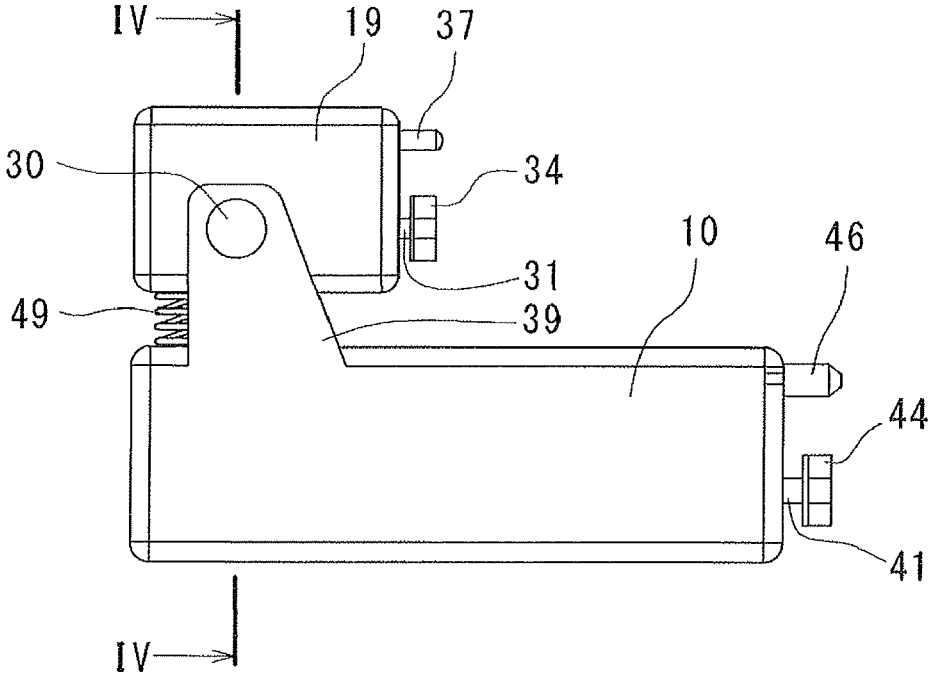
FIG. 3B is a side view of the single-body type imaging unit of the present invention.
Figure 4:
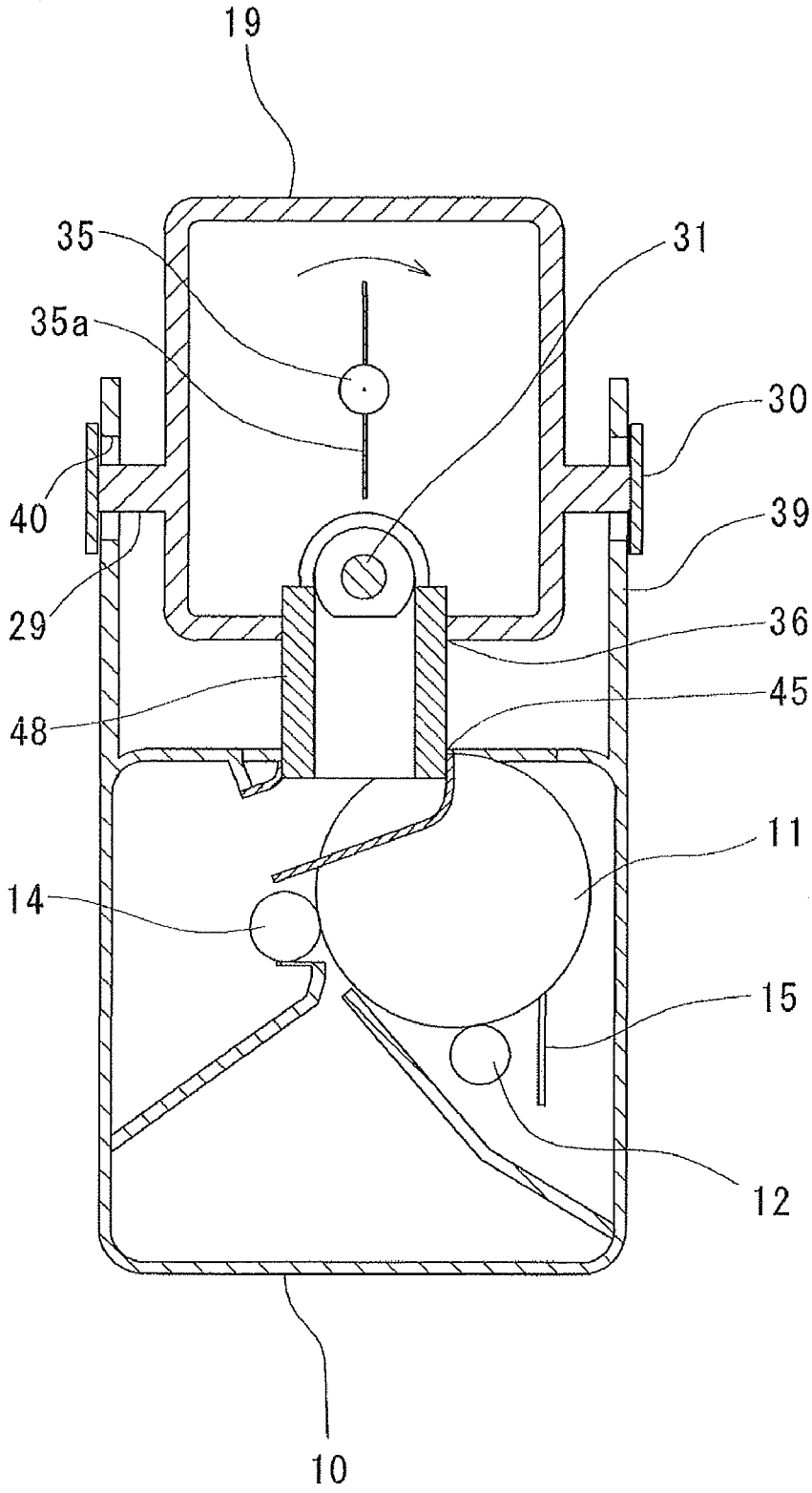
FIG. 4 is a sectional view of FIG. 3B taken along line IV-IV.
Figure 5:
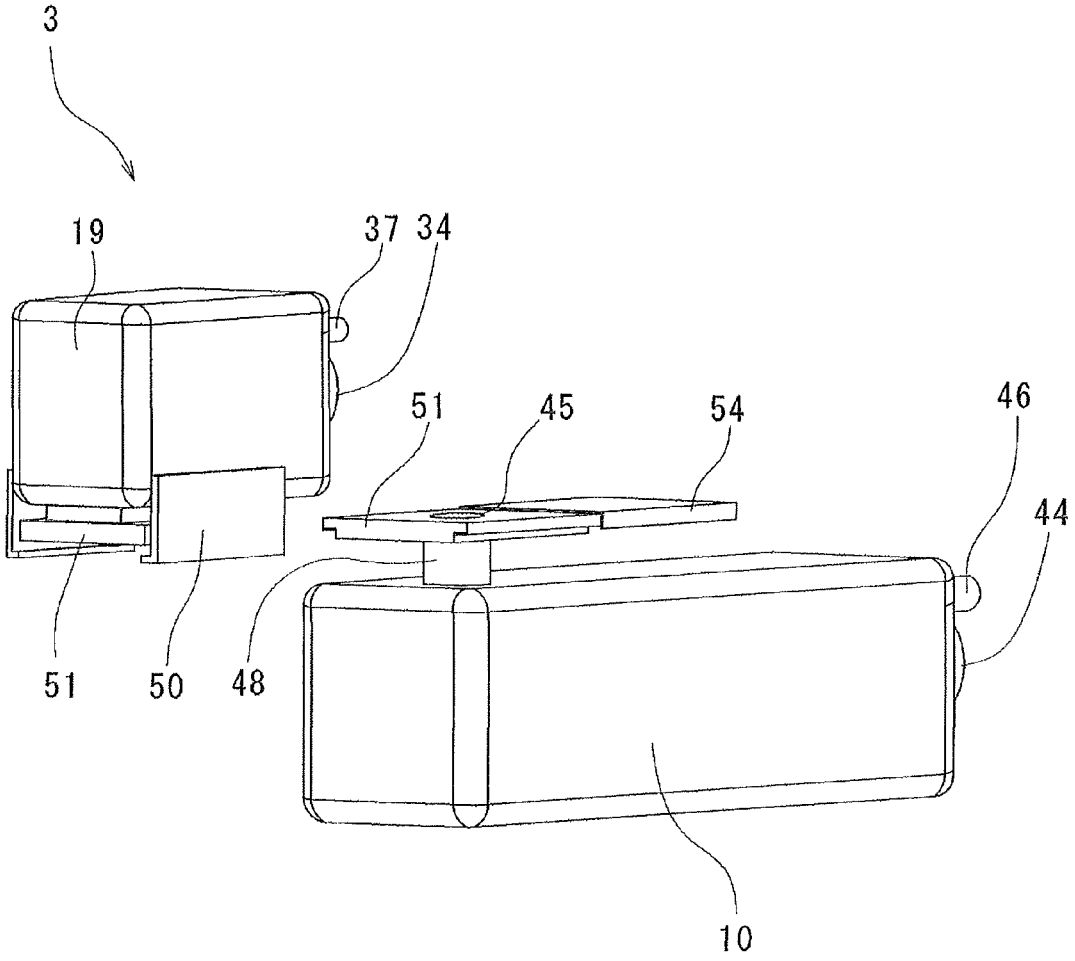
FIG. 5 is a view showing a double-body type imaging unit of the present invention.
Figure 6A:
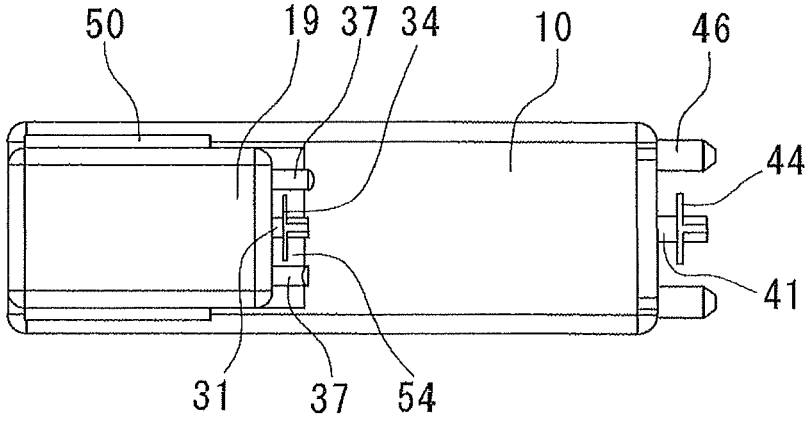
FIG. 6A is a top view of the double-body type imaging unit of the present invention.
Figure 6B:
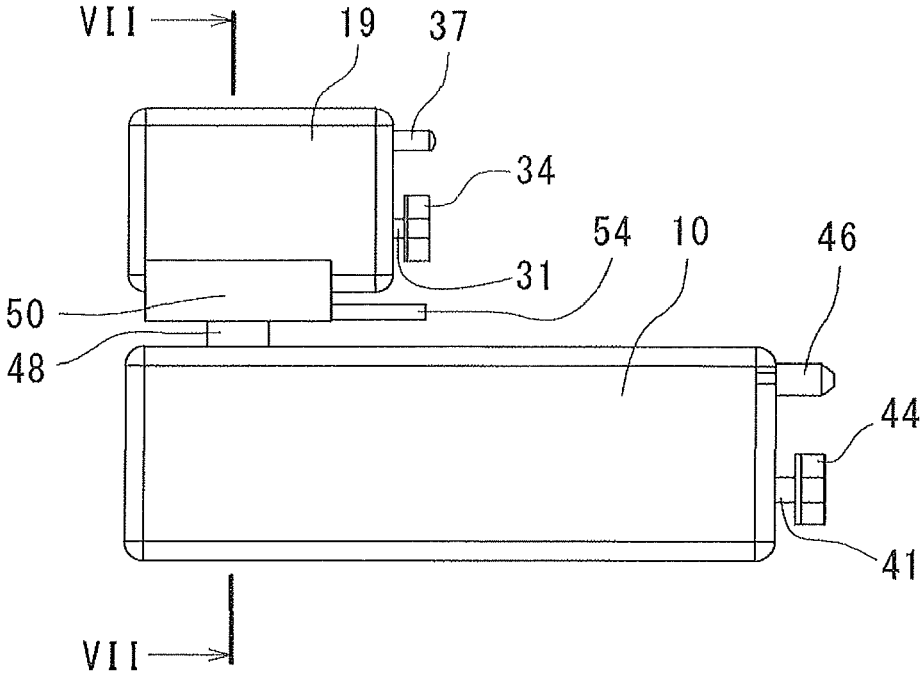
FIG. 6B is a side view of the double-body type imaging unit of the present invention.
Figure 7:
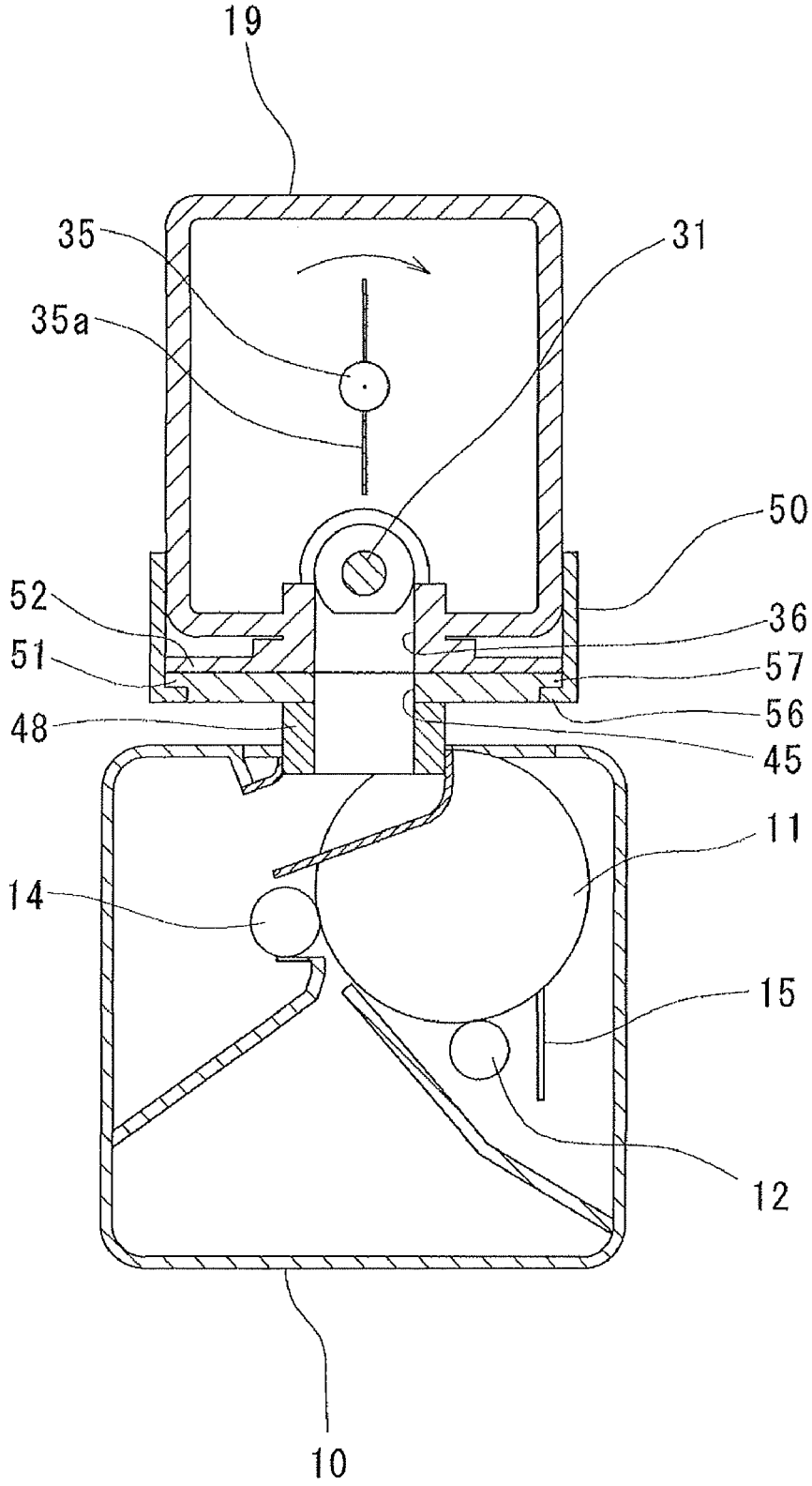
FIG. 7 is a sectional view of FIG. 6B taken along line VII-VII.

FIG. 1 is a schematic view related to a general tandem type image formation apparatus of a full color electronic photograph system to which the present invention is applied.

Four print units 10Y, 10M, 10C, 10K of yellow (Y), magenta (M), cyan (C) and black (K) are arranged in an image formation apparatus 1.

In each of the print units 10Y, 10M, 10C, 10K, a charger 12, a developing device 14 and a cleaning device 15 are provided around a photoconductor drum (an image carrier) 11. Image exposure devices 13 are provided in a main body 2 of the image formation apparatus. On the upper side of the print units 10Y, 10M, 10C, 10K, an intermediate transfer belt 16 is stretched round a pair of rollers 17, and circulated and moved in the arrow direction by drive means (not shown). On the inner side of the intermediate transfer belt 16, primary transfer devices 18 are provided so as to face the photoconductor drums 11. On the outer side of the intermediate transfer belt 16, a secondary transfer device 20 facing one of the rollers 17 and a transfer belt cleaning device 21 facing the other roller 17 are provided. Further, on the lower side of the print units 10Y, 10M, 10C, 10K, a paper supply cassette 23 accommodating recording paper (recording medium) 22 is provided. A recording medium feed passage 25 is formed from the paper supply cassette 23 to a paper discharge tray 24 on an upper surface via the secondary transfer device 20. Feed rollers 26 are provided between the paper supply cassette 23 and the secondary transfer device 20 in the recording medium feed passage 25. A fixing device 27 is provided between the secondary transfer device 20 and the paper discharge tray 24 in the recording medium feed passage 25, and paper discharge rollers 28 are provided between the fixing device 27 and the paper discharge tray 24. On the upper side of the print units 10Y, 10M, 10C, 10K, toner bottles 19 are attached. On the front side of the print units 10Y, 10M, 10C, 10K (on the front surface side of the paper in the figure), a waste powder collecting device (not shown) is attached. The print units 10 and the toner bottles 19 are coupled to each other so as to form an imaging unit 3.

In the print unit 10K, a surface of the photoconductor drum 11 is uniformly charged at desired potential by the charger 12, and the surface of the photoconductor drum 11 is irradiated with light by the image exposure device 13 based on image data so as to form an electrostatic latent image. Toner is supplied from the developing device 14 to the photoconductor drum 11 on which the electrostatic latent image is formed, so that the electrostatic latent image is developed and formed as a toner image on the photoconductor drum 11. Similarly, toner images are respectively formed in the other print units 10Y, 10M, 10C. The developed toner images are successively transferred to the intermediate transfer belt 16 by the primary transfer devices 18Y, 18M, 18C, 18K. The four color toner images overlying one another are collectively transferred by the secondary transfer device 20 from the intermediate transfer belt 16 to the recording paper 22 fed by the feed rollers 26 from the paper supply cassette 23. After the toner images transferred to the recording paper 22 are fixed by the fixing device 27, the recording paper 22 is discharged by the paper discharge rollers 28 to the paper discharge tray 24.

The toner remaining on the photoconductor drums 11Y, 11M, 11C, 11K without being transferred by the primary transfer devices 18 is scraped by the cleaning devices 15Y, 15M, 15C, 15K including cleaning blades. The toner remaining on the intermediate transfer belt 16 without being transferred by the secondary transfer device 20 is scraped by the transfer belt cleaning device 21 including a cleaning blade. The toner scraped by the cleaning devices 15Y, 15M, 15C, 15K and the transfer belt cleaning device 21 is collected by the waste powder collecting device (not shown).

Next, the imaging unit 3 according to the present invention will be described. As a mode of the imaging unit 3, there are two modes including a (single-body type) imaging unit in which the toner bottles 19 and the print units 10 are integrated and assembled as shown in FIGS. 2, 3A, 3B, 4, 8A and 9A, and a (double-body type) imaging unit in which the toner bottles 19 and the print units 10 are formed into separate bodies but connected to each other as shown in FIGS. 5, 6A, 6B, 7, 8B and 9B.

Each of the toner bottles 19 of the single-body type imaging unit 3 is formed into a substantially rectangular parallelepiped. On both side surfaces of the toner bottle 19 which are parallel to the longitudinal direction, insertion shafts 29 protruding in the direction orthogonal to the longitudinal direction are provided. Flange shape retainers 30 are attached to ends of the insertion shafts 29 in a state that the insertion shafts are inserted into insertion holes 40 of the print unit 10 described later. On aside surface facing the main body 2 of the image formation apparatus among side surfaces of the toner bottle 19 which are orthogonal to the longitudinal direction, a drive shaft 31 passing through the side surface is provided. A coupling engagement portion 34 to be engaged with a coupling engagement portion 33 provided in a front end of a drive force transmission portion 32 in the main body 2 of the image formation apparatus is provided in an end of the drive shaft 31 on the outer side of the toner bottle 19. When the drive shaft 31 is rotated, the inside toner is transferred by a screw provided in the drive shaft 31. A discharge port 36 is provided on a bottom surface of the toner bottle 19. On the side surface facing the main body 2 of the image formation apparatus, positioning bosses 37 are provided at two positions in the horizontal direction corresponding to positioning holes 38*a*, 38*b* in the main body 2 of the image formation apparatus described later. A stirring portion 35 driven by the drive shaft 31 through a gear (not shown) is provided inside the toner bottle 19 in parallel to the drive shaft 31. The stirring portion 35 is provided with a stirring plate 35*a* orthogonal to the drive shaft 31 so as to extend in the axial direction.

Each of the print units 10 is formed into a substantially rectangular parallelepiped. In the print unit 10, at least part of the surface of the photoconductor drum 11 is exposed so as to face the intermediate transfer belt 16. However, in FIGS. 2, 3, 8, 9, an opening for the exposure is not shown in order to avoid complication of the figures. On both side surfaces of the print unit 10 which are parallel to the longitudinal direction, thin plate shape support portions 39 for supporting the insertion shafts 29 of the toner bottle 19 are provided so as to protrude upward at positions corresponding to the insertion shaft 29 of the toner bottle 19. The insertion holes 40 into which the insertion shafts 29 are inserted are provided in the support portions 39. A diameter of the insertion holes 40 is sufficiently large so as to leave some play relative to an outer diameter of the insertion shafts 29. On a side surface facing the main body 2 of the image formation apparatus among side surfaces of the print unit 10 which are orthogonal to the longitudinal direction, a drive shaft 41 passing through the side surface is provided. A coupling engagement portion 44 to be engaged with a coupling engagement portion 43 provided in a front end of a drive force transmission portion 42 in the main body 2 of the image formation apparatus is provided in an end of the drive shaft 41 on the outer side of the print unit 10. Drive force of the drive shaft 41 is transmitted to the photoconductor drum (the image carrier) 11 and the developing device 14. A supply port 45 is provided on an upper surface of the print unit 10. On the side surface facing the main body 2 of the image formation apparatus, positioning bosses 46 are provided at two positions in the horizontal direction corresponding to positioning holes 47*a*, 47*b* in the main body 2 of the image formation apparatus described later.

An elastic member 48 is provided and sealingly connected between the discharge port 36 of the toner bottle 19 and the supply port 45 of the print unit 10. The elastic member 48 is a flexible rubber tube, and an interior thereof serves as a supply passage for supplying the toner from the toner bottle 19 to the print unit 10. The toner bottle 19 is oscillatable relative to the print unit 10 by the connection via the elastic member 48. In the toner bottle 19, since the insertion shafts 29 have some play relative to the insertion holes 40 of the print unit 10, movement in the direction orthogonal to the shaft of the elastic member 48 and rotation around the shaft are allowed within a fixed range. A posture stabilizing spring 49 for maintaining a fixed posture of the toner bottle 19 is provided between the bottom surface of the toner bottle 19 and the upper surface of the print unit 10.

Each of the toner bottles 19 of the double-body type imaging unit 3 is formed into a substantially rectangular parallelepiped. On both side surfaces of the toner bottle 19 which are parallel to the longitudinal direction, there are provided plate shape coupling portions 50 protruding downward from a bottom surface in parallel to the side surfaces and bending inward at the lowest parts so as to be formed into an L shape in sections orthogonal to the longitudinal direction. In the present embodiment, the inward bent parts of the L shape of the coupling portions 50 serve as toner bottle engagement portions 56. On a side surface facing the main body 2 of the image formation apparatus among side surfaces of the toner bottle 19 which are orthogonal to the longitudinal direction, a drive shaft 31 passing through the side surface is provided. A coupling engagement portion 34 to be engaged with the coupling engagement portion 33 provided in the front end of the drive force transmission portion 32 in the main body 2 of the image formation apparatus is provided in an end of the drive shaft 31 on the outer side of the toner bottle 19. When the drive shaft 31 is rotated, the inside toner is conveyed by a screw provided in the drive shaft 31. A toner bottle flange portion 52 is provided on the bottom surface of the toner bottle 19 so as to nip and couple print unit engagement portions 57 of a print unit flange portion 51 of the print unit 10 described later with the toner bottle engagement portions 56 inside the coupling portions 50. A discharge port 36 is provided in the toner bottle flange portion 52. On the side surface facing the main body 2 of the image formation apparatus, positioning bosses 37 are provided at two positions in the horizontal direction corresponding to the positioning holes 38*a*, 38*b* in the main body 2 of the image formation apparatus described later. A stirring portion 35 driven by the drive shaft 31 through a gear (not shown) is provided inside the toner bottle 19 in parallel to the drive shaft 31. The stirring portion 35 is provided with a stirring plate 35*a* orthogonal to the drive shaft 31 so as to extend in the axial direction.

Each of the print units 10 is formed into a substantially rectangular parallelepiped. In the print unit 10, at least part of the surface of the photoconductor drum 11 is exposed so as to face the intermediate transfer belt 16. However, in FIGS. 5, 6, 8, 9, an opening for the exposure is not shown in order to avoid complication of the figures. The print unit flange portion 51 is connected on the upper surface of the print unit 10 at a position corresponding to the coupling portions 50 of the toner bottle 19 via the elastic member 48. That is, the print unit flange portion 51 is positioned on the upper side of the upper surface of the print unit 10. Ends of the print unit flange portion 51 in the direction orthogonal to the axial direction of the drive shaft 31 serve as print unit engagement portions 57. The print unit flange portion 51 has cutout parts which correspond to the inward bent parts formed into an L shape at the lowest parts in the sections orthogonal to the longitudinal direction of the toner bottle 19 and which extend in the axial direction of the drive shaft 31. A supply port 45 for supplying the toner to an interior of the print unit 10 is provided in the print unit flange portion 51. A shutter 54 for opening and closing the supply port 45 is provided in the print unit flange portion 51. The print unit engagement portions 57 of the print unit flange portion 51 are sandwiched and coupled between the toner bottle flange portion 52 and the toner bottle engagement portions 56 inside the coupling portions 50 of the toner bottle 19. When the toner bottle flange portion 52 is moved sideways while being in contact with an upper surface of the print unit flange portion 51 inside the coupling portions 50, the shutter 54 of the print unit flange portion 51 is pushed toward an exterior of the coupling portions 50 on the side of the coupling engagement portion 34. The supply port 45 of the print unit 10 is sealingly connected to the discharge port 36 of the toner bottle 19. The toner bottle 19 of the double-body type imaging unit 3 is oscillatable relative to the print unit 10 by the connection to the print unit flange portion 51 via the elastic member 48. The elastic member 48 is a flexible rubber tube, and an interior thereof serves as a supply passage for supplying the toner from the toner bottle 19 to the print unit 10. In the toner bottle 19, movement in the direction orthogonal to the shaft of the elastic member 48 and rotation around the shaft are allowed within a fixed range. On a side surface facing the main body 2 of the image formation apparatus among side surfaces of the print unit 10 which are orthogonal to the longitudinal direction, a drive shaft 41 passing through the side surface is provided. A coupling engagement portion 44 to be engaged with the coupling engagement portion 43 provided in the front end of the drive force transmission portion 42 in the main body 2 of the image formation apparatus is provided in an end of the drive shaft 41 on the outer side of the print unit 10. Drive force of the drive shaft 41 is transmitted to the photoconductor drum (the image carrier) 11 and the developing device 14. On the side surface facing the main body 2 of the image formation apparatus, positioning bosses 46 are provided at two positions in the horizontal direction corresponding to the positioning holes 47 in the main body 2 of the image formation apparatus described later.

In the single-body type and double-body type imaging units 3, lines forming outer shapes of the toner bottle 19 and the print unit 10 are the same, and relative positions between the positioning bosses 37, 46 and the coupling engagement portion 34, 44 are the same on the surface facing the main body 2 of the image formation apparatus.

Figure 8A:
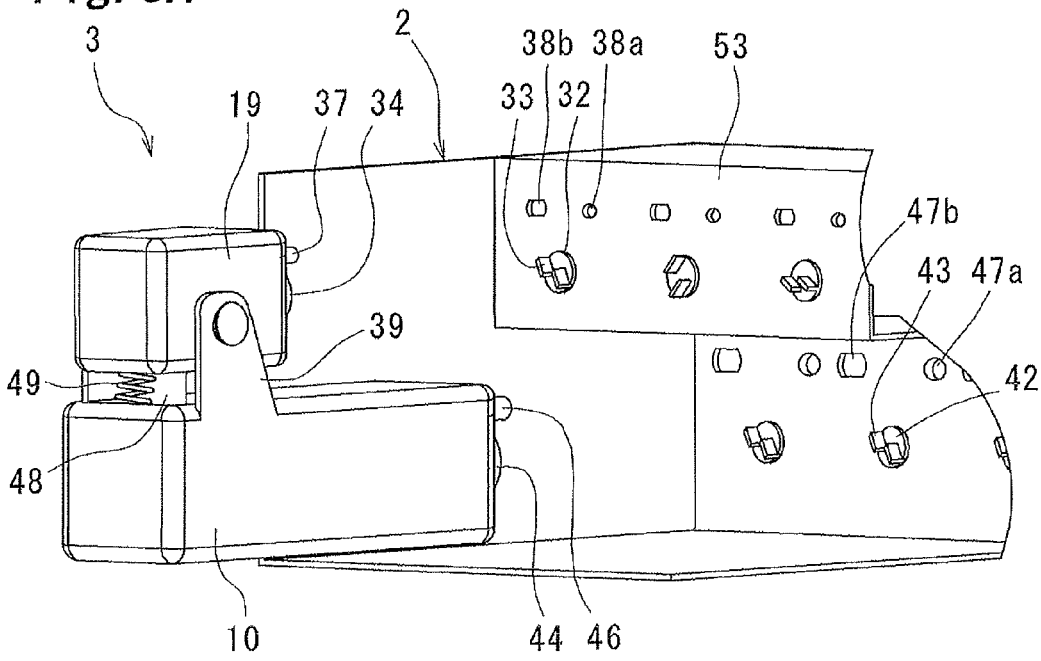
FIG. 8A is a view showing the single-body type imaging unit of the present invention and an attached part in a main body of the image formation apparatus.
Figure 8B:
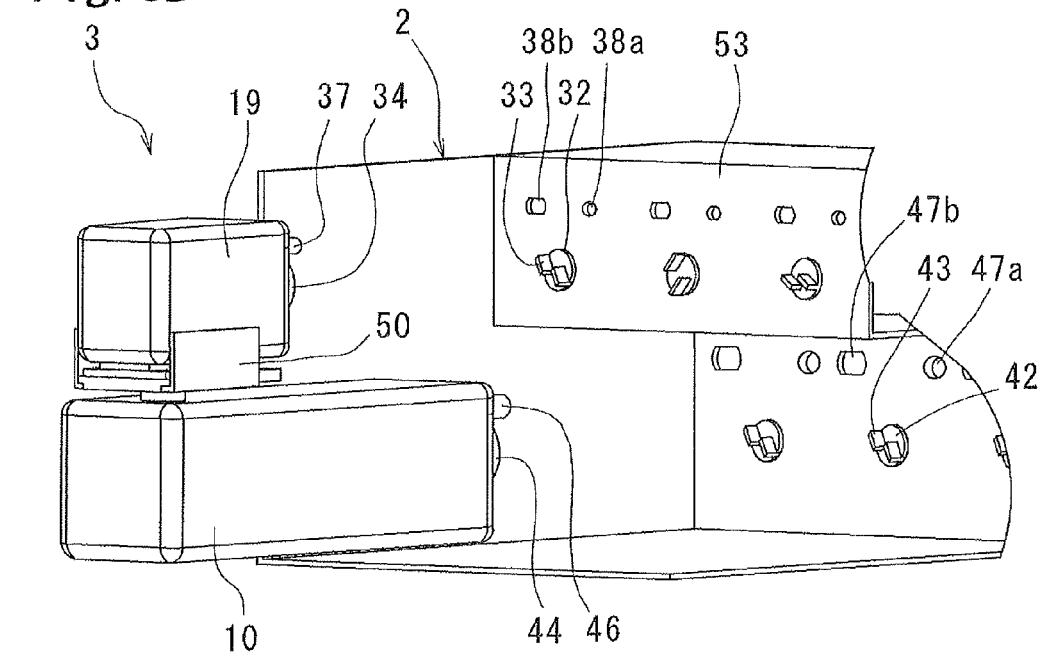
FIG. 8B is a view showing the double-body type imaging unit of the present invention and the attached part in the main body of the image formation apparatus.
Figure 9A:
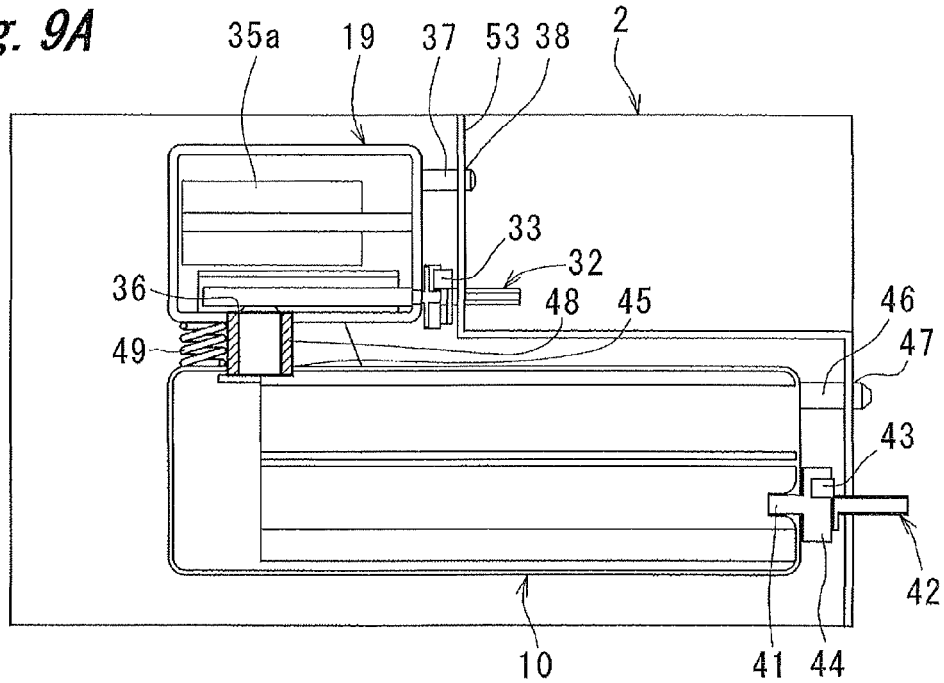
FIG. 9A is a side view showing attachment of the single-body type imaging unit of the present invention to the main body of the image formation apparatus.
Figure 9B:
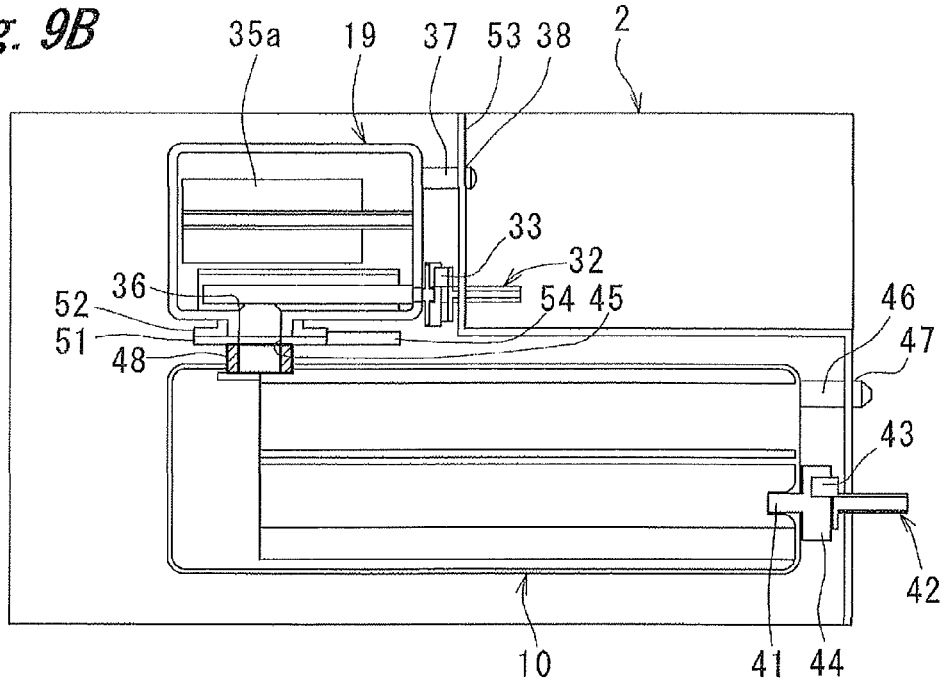
FIG. 9B is a side view showing attachment of the double-body type imaging unit of the present invention to the main body of the image formation apparatus.
Figure 10:
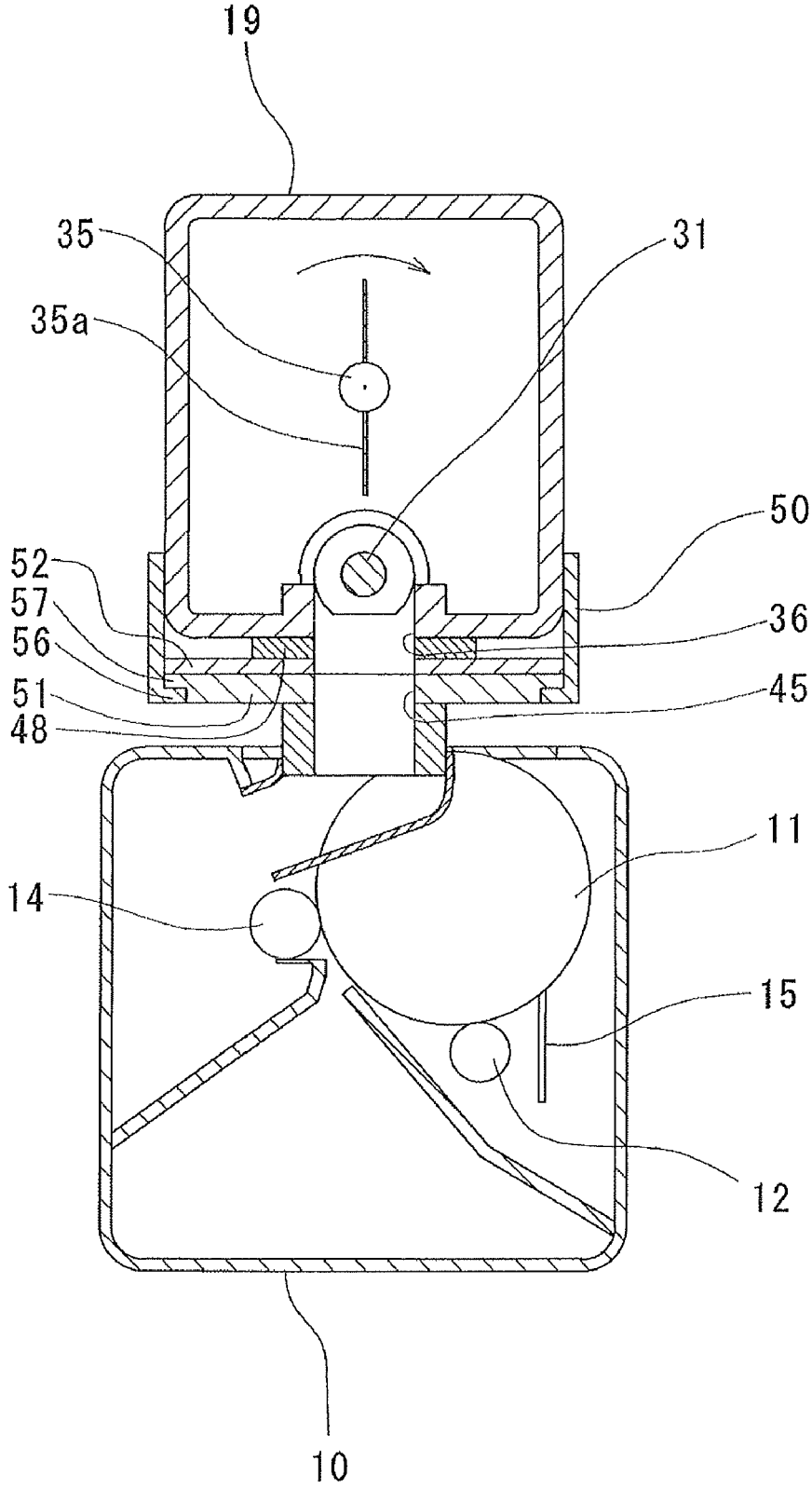
FIG. 10 is a view showing a modified example of the same section as FIG. 7.
Figure 11:
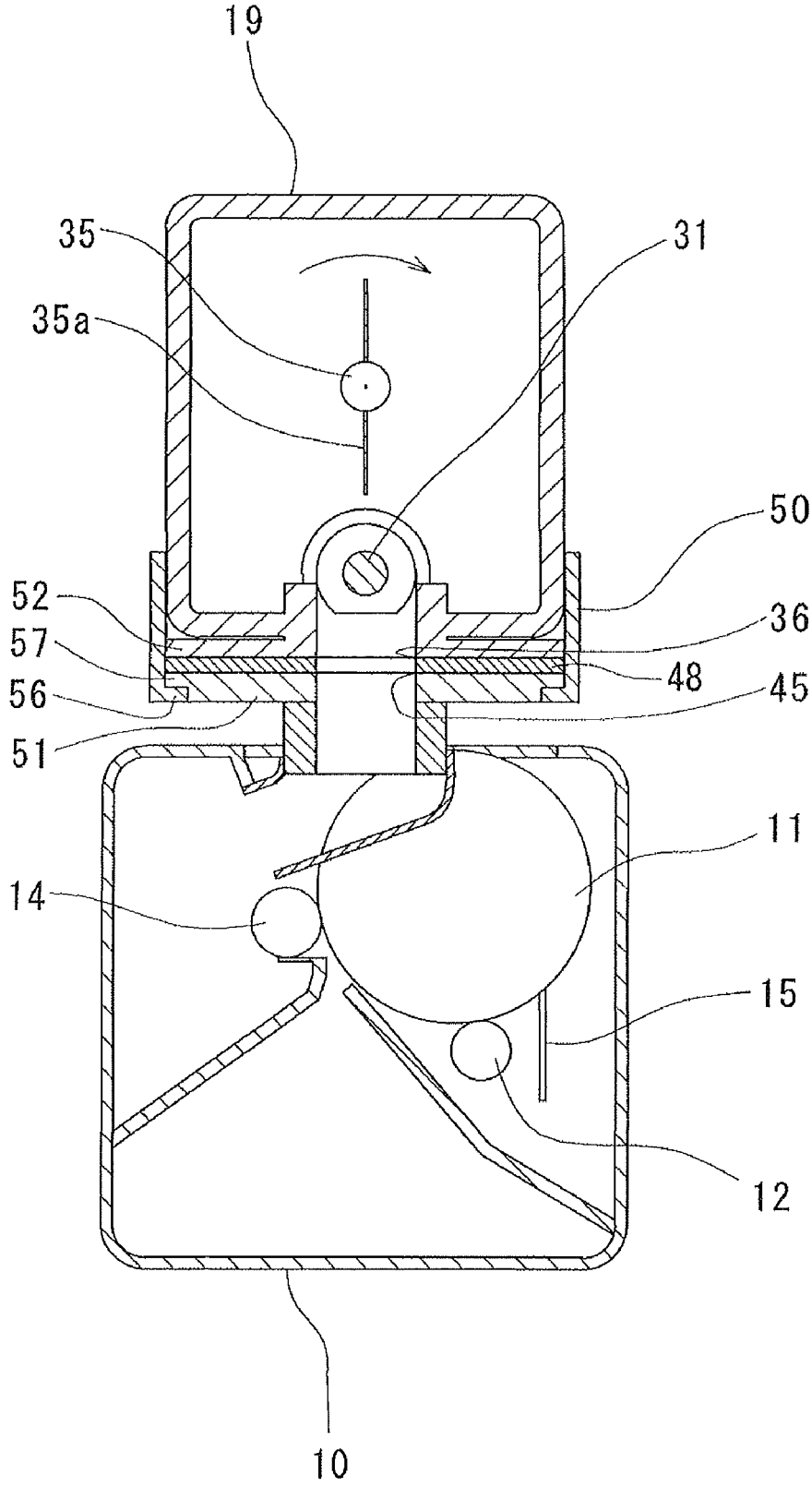
FIG. 11 is a view showing a modified example of the same section as FIG. 7.
Figure 12:
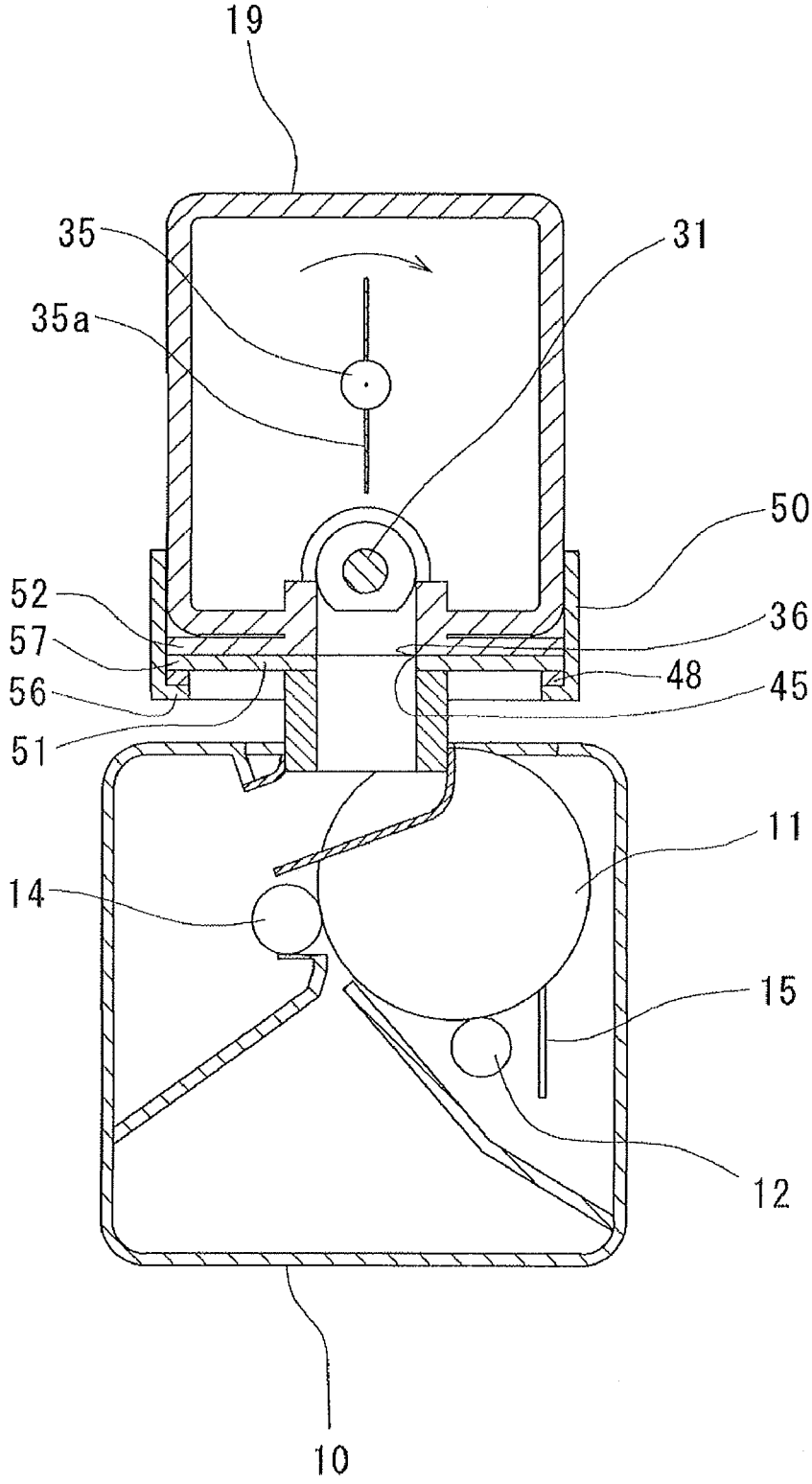
FIG. 12 is a view showing a modified example of the same section as FIG. 7.
Figure 13:
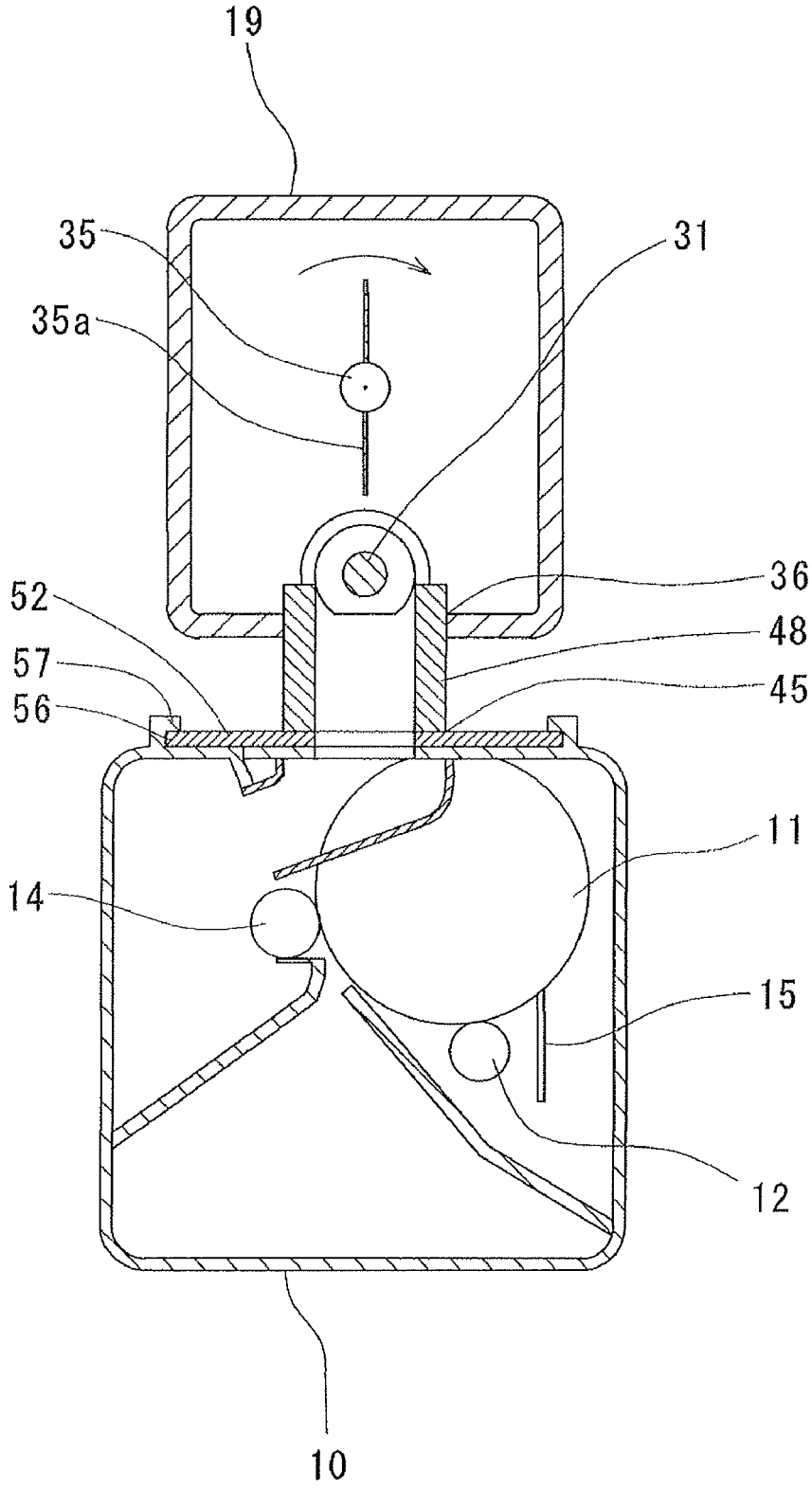
FIG. 13 is a view showing a modified example of the same section as FIG. 7.

FIGS. 8A and 8B show an attached portion 53 in the main body 2 of the image formation apparatus to which the single-body type and double-body type imaging units 3 are attached. The drive force transmission portions 32, 42 and the positioning holes 38*a*, 38*b*, 47*a*, 47*b* are provided in the attached portion 53. The coupling engagement portions 33, 43 are provided in the ends of the drive force transmission portions 32, 42. On the upper side of the drive force transmission portions 32, 42, pairs of the positioning holes 38*a*, 38*b*, 47*a*, 47*b* for respectively placing the toner bottle 19 and the print unit 10 at attachment positions are respectively provided in the horizontal direction. Respective ones of the positioning holes 38*a*, 38*b*, 47*a*, 47*b* are round holes 38*a*, 47*a*, and the other holes are elongated holes 38*b*, 47*b* having a diameter elongated in the horizontal direction. The toner bottle 19 and the print unit 10 are reliably positioned by the round holes 38*a*, 47*a*, and size errors between the respective positioning bosses 37, 46 of the toner bottle 19 and the print unit 10 can be covered by the elongated holes 38*b*, 47*b*.

Next, attachment of the imaging unit 3 with the above configuration to the main body 2 of the image formation apparatus, and operations thereof will be described.

The single-body type imaging unit 3 is inserted into a predetermined position of the main body 2 of the image formation apparatus. At this time, the positioning bosses 37, 46 are fitted into the positioning holes 38*a*, 38*b*, 47*a*, 47*b* and pushed toward positions in which the coupling engagement portion 34 of the toner bottle 19 and the coupling engagement portion 33 of the drive force transmission portion 32 are engaged with each other.

Regarding the double-body type imaging unit 3, firstly, the toner bottle 19 and the print unit 10 are assembled to each other. In the assembling, the print unit flange portion 51 is sandwiched between the toner bottle flange portion 52 of the toner bottle 19 and the toner bottle engagement portions 56 inside the coupling portions 50 of the toner bottle 19. At this time, while the toner bottle engagement portions 56 and the print unit engagement portions 57 are engaged with each other, the print unit flange portion 51 is moved to a position in which end surfaces of the coupling portions 50 of the toner bottle 19 on the opposite side of the coupling engagement portion 34 and an end surface of the print unit flange portion 51 of the print unit 10 are on the same plane. In this manner, the shutter 54 is pushed toward the exterior of the coupling portions 50, so that the supply port 45 of the print unit 10 and the discharge port 36 of the toner bottle 19 communicate with each other. The double-body type imaging unit 3 assembled in such a manner is inserted into a predetermined position of the main body 2 of the image formation apparatus. At this time, in the same manner as the single-body type imaging unit 3, the positioning bosses 37, 46 are fitted into the positioning holes 38*a*, 38*b*, 47*a*, 47*b* and pushed toward positions in which the coupling engagement portion 34 of the toner bottle 19 and the coupling engagement portion 33 of the drive force transmission portion 32 are engaged with each other.

The single-body type and double-body type imaging units 3 are designed so that the outer shapes have the same size, and the positioning bosses 37, 46 of the toner bottle 19 and the print unit 10 and the coupling engagement portions 33, 43 of the drive force transmission portions 32, 42 are at the same positions. Therefore, the imaging units are compatible with each other, and both units can be attached to the main body 2 of the same image formation apparatus with compatibility. In the double-body type imaging unit 3, the toner bottle 19 and the print unit 10 are coupled to each other via the elastic member 48 so that an elastic part is provided inside the imaging unit 3. Therefore, the double-body type imaging unit 3 is compatible with the single-body type imaging unit 3, and is capable of being attached to the main body 2 of the image formation apparatus requiring no elastic part for absorbing oscillation in the attached portion 53 in the main body 2 of the image formation apparatus.

At the time of image formation, after a predetermined signalization process is performed, color print data obtained by reading the images, or image data outputted from a personal computer or the like are sent to the imaging units 3 as image signals of yellow (Y), magenta (M), cyan (C) and black (Bk). Then, the drive force transmission portions 32, 42 of the main body 2 of the image formation apparatus are driven. Since the drive force transmission portions 32, 42 have an identical specification to have no elastic part, the oscillation is generated from the drive shaft 31 of the toner bottle 19 in any of the single-body type and double-body type imaging units 3. However, according to the imaging unit 3 of the present invention, in any of the single-body type and double-body type imaging units 3, the toner bottle 19 and the print unit 10 are coupled to each other via the elastic member 48. Therefore, transmission of the oscillation generated by the drive shaft 31 of the toner bottle 19 to the print unit 10 can be suppressed by the elastic member 48, so that color deviation in the print unit 10 can be prevented. Since pressing force is not generated between the toner bottle 19 and the print unit 10, displacement of the print unit 10 can be prevented, so that the color deviation in the print unit 10 can be prevented. Thereby, there is no need for providing the elastic part which is indispensable for the single-body type imaging unit 3 in the attached portion 53 in the main body 2 of the image formation apparatus. Therefore, the attached portion 53 can be commonly used. With a simple structure in which the toner bottle 19 and the print unit 10 are coupled to each other via the elastic member 48 for the common use, an increase in cost for the common use can be suppressed. By elastically deforming the elastic member 48, looseness can be provided between the toner bottle 19 and the print unit 10.

It should be noted that the present embodiment is only an example and is not intended to limit the present invention in any way. Therefore, as a matter of course, the present invention can be variously improved or modified within a range not departing from the gist thereof. For example, as shown in FIGS. 10, 11, 12 and 13, in the imaging unit 3 according to the present invention, the elastic member 48 may be interposed between the print unit 10 and the print unit engagement portions 57, between the toner bottle 19 and the toner bottle engagement portions 56, or between the print unit engagement portions 57 and the toner bottle engagement portions 56, so that the toner bottle 19 and the print unit 10 are separably coupled to each other.

Figure 14A:
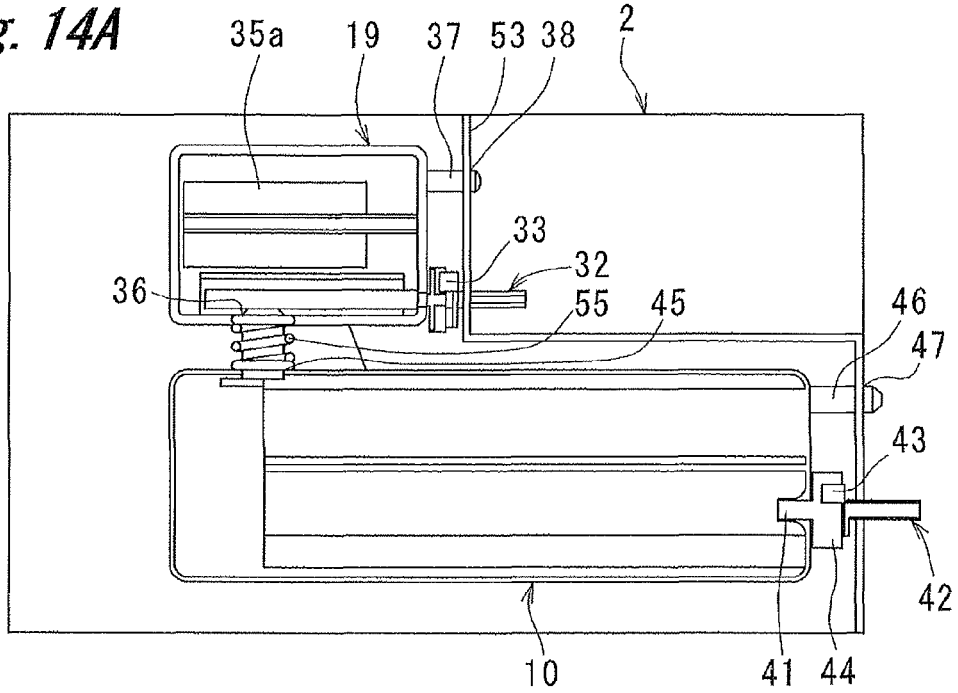
FIG. 14A is a view showing another modified example of the imaging unit to be attached to the main body of the image formation apparatus.
Figure 14B:
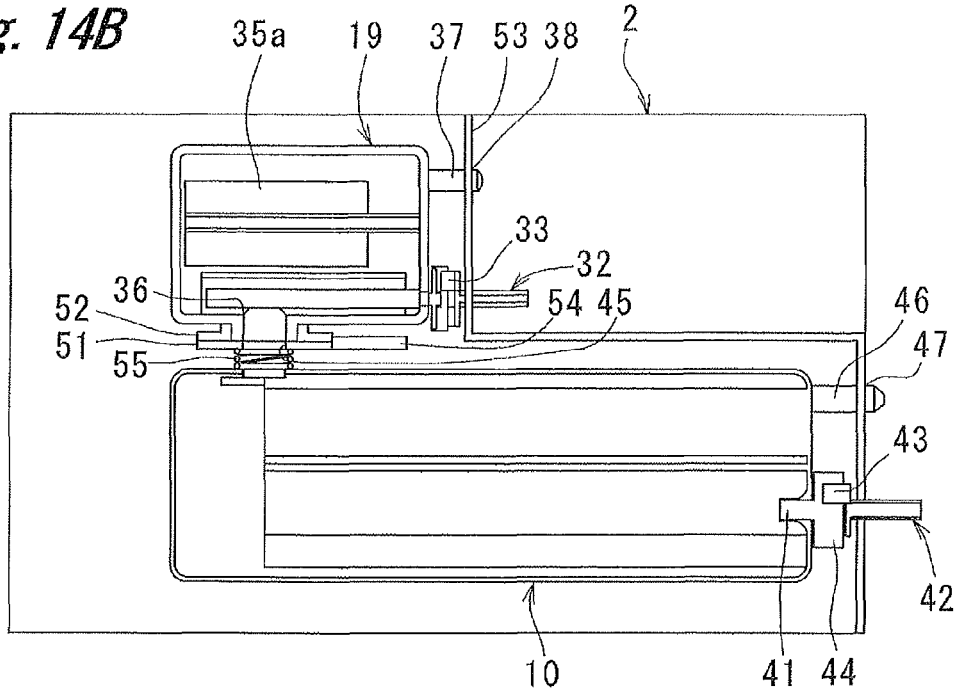
FIG. 14B is a view showing yet another modified example of the imaging unit to be attached to the main body of the image formation apparatus.

FIGS. 14A and 14B show another modified example of the imaging unit 3 to be attached to the main body 2 of the image formation apparatus. The same constituent elements as the above embodiment are denoted with the same reference numerals, and description thereof will not be given.

In the single-body type imaging unit 3, the bottom surface of the toner bottle 19 and the upper surface of the print unit 10 may be supported by a spring (an elastic member) 55 instead of the elastic member 48 including the rubber tube, and the discharge port 36 of the toner bottle 19 and the supply port 45 of the print unit 10 may be connected to each other by a flexible tube inside the spring 55. In the double-body type imaging unit 3, the bottom surface of the print unit flange portion 51 and the upper surface of the print unit 10 may be supported by the spring 55, and the supply port 45 of the print unit flange portion 51 and the interior of the print unit 10 may be connected to each other by a flexible tube inside the spring 55. In the assembling of the double-body type imaging unit 3 to the main body 2 of the image formation apparatus, the toner bottle 19 and the print unit 10 already assembled to each other are assembled to the main body 2 of the image formation apparatus. However, the toner bottle 19 and the print unit 10 may be separately assembled to the main body 2 of the image formation apparatus. At this time, the toner bottle 19 and the print unit 10 are coupled to each other in accordance with an assembling operation to the main body 2 of the image formation apparatus.

What is claimed is:

1. A single-body type imaging unit, comprising:

a toner bottle provided with a drive shaft; and a print unit provided with a drive shaft, wherein the toner bottle and the print unit are coupled to each other via an elastic member, the elastic member being configured to allow the toner bottle to oscillate relative to the print unit.

2. The imaging unit according to claim 1, wherein the elastic member is a flexible tube having a toner supply passage from the toner bottle to the print unit.

3. The imaging unit according to claim 1, wherein the elastic member is configured to elastically deform when the toner bottle moves away from the print unit.

4. The imaging unit according to claim 1, wherein the toner bottle possesses a lower surface facing the print unit and a first opening extending through the lower surface, the print unit possesses an upper surface facing the toner bottle and a second opening extending through the upper surface, the elastic member is a flexible tube extending between the first opening and the second opening, and the lower surface of the toner bottle is spaced apart from the upper surface of the print unit so that a gap exists between the lower surface of the toner bottle and the upper surface of the print unit, wherein the gap surrounds the elastic member.

5. A single-body type imaging unit, comprising:

a toner bottle provided with a drive shaft; and a print unit provided with a drive shaft, wherein the toner bottle and the print unit are coupled to each other via an elastic member, the toner bottle and the print unit are coupled to each other by a spring, a flexible tube is provided inside the spring, and a toner discharge port of the toner bottle and a toner supply port of the print unit are connected to each other by the tube.

6. A double-body type imaging unit, comprising:

a toner bottle provided with a drive shaft;

a print unit provided with a drive shaft;

a toner bottle engagement portion provided in the toner bottle;

a print unit engagement portion provided in the print unit to be engaged with the toner bottle engagement portion, wherein an elastic member is interposed between the print unit and the print unit engagement portion, between the toner bottle and the toner bottle engagement portion, or between the print unit engagement portion and the toner bottle engagement portion, so that the toner bottle and the print unit are separably coupled to each other; and wherein the elastic member is configured to permit the toner bottle to oscillate relative to the print unit.

7. The imaging unit according to claim 6, wherein the elastic member is a flexible tube having a toner supply passage from the toner bottle to the print unit.

8. The imaging unit according to claim 6, wherein the elastic member is configured to elastically deform when the toner bottle moves away from the print unit.

9. The imaging unit according to claim 6, wherein the toner bottle possesses a lower surface facing the print unit and a first opening extending through the lower surface, the print unit possesses an upper surface facing the toner bottle and a second opening extending through the upper surface, the elastic member is a flexible tube extending between the first opening and the second opening, and the lower surface of the toner bottle is spaced apart from the upper surface of the print unit so that a gap exists between the lower surface of the toner bottle and the upper surface of the print unit, wherein the gap surrounds the elastic member.

10. A double-body type imaging unit, comprising:

a toner bottle provided with a drive shaft;

a print unit provided with a drive shaft;

a toner bottle engagement portion provided in the toner bottle;

a print unit engagement portion provided in the print unit to be engaged with the toner bottle engagement portion, wherein an elastic member is interposed between the print unit and the print unit engagement portion, between the toner bottle and the toner bottle engagement portion, or between the print unit engagement portion and the toner bottle engagement portion, so that the toner bottle and the print unit are separably coupled to each other;

wherein the toner bottle and the print unit are coupled to each other by a spring;

a flexible tube is provided inside the spring; and a toner discharge port provided in the toner bottle and a toner supply port provided in the print unit are connected to each other by the tube.

11. An image formation apparatus, comprising:

an imaging unit including a toner bottle having a drive shaft, and a print unit having a drive shaft; and an attached portion to which the imaging unit is attached, wherein in a state that the toner bottle and the print unit are coupled to each other via an elastic member, the imaging unit is attached to the attached portion, the toner bottle and the print unit are connected via the elastic member so as to form a single-body type imaging unit, and the toner bottle is supported so as to be oscillatable relative to the print unit.

12. The image formation apparatus according to claim 11, wherein the elastic member is a flexible tube having a toner supply passage from the toner bottle to the print unit.

13. The image formation apparatus according to claim 11, wherein the imaging unit further includes:

a toner bottle engagement portion provided in the toner bottle; and a print unit engagement portion provided in the print unit to be separably engaged with the toner bottle engagement portion, wherein in a state that the toner bottle and the print unit are coupled to each other, the elastic member is interposed between the print unit and the print unit engagement portion, between the toner bottle and the toner bottle engagement portion, or between the print unit engagement portion and the toner bottle engagement portion.

14. The image formation device according to claim 13, wherein in a state that the toner bottle and the print unit are coupled to each other, the toner bottle is supported so as to be oscillatable relative to the print unit.

15. The image formation apparatus according to claim 11, wherein the elastic member is configured to elastically deform when the toner bottle moves away from the print unit.

16. The image formation apparatus according to claim 11, wherein the toner bottle possesses a lower surface facing the print unit and a first opening extending through the lower surface, the print unit possesses an upper surface facing the toner bottle and a second opening extending through the upper surface, the elastic member is a flexible tube extending between the first opening and the second opening, and the lower surface of the toner bottle is spaced apart from the upper surface of the print unit so that a gap exists between the lower surface of the toner bottle and the upper surface of the print unit, wherein the gap surrounds the elastic member.

17. An image formation apparatus, comprising:

an imaging unit including a toner bottle having a drive shaft, and a print unit having a drive shaft; and an attached portion to which the imaging unit is attached, wherein in a state that the toner bottle and the print unit are coupled to each other via an elastic member, the imaging unit is attached to the attached portion, the toner bottle and the print unit are coupled to each other by a spring, a flexible tube is provided inside the spring, and a toner discharge port of the toner bottle and a toner supply port of the print unit are connected to each other by the tube.

18. An image formation apparatus, comprising:

an imaging unit including a toner bottle having a drive shaft, and a print unit having a drive shaft;

an attached portion to which the imaging unit is attached;

wherein in a state that the toner bottle and the print unit are coupled to each other via an elastic member, the imaging unit is attached to the attached portion;

the imaging unit further includes a toner bottle engagement portion provided in the toner bottle, and a print unit engagement portion provided in the print unit to be separably engaged with the toner bottle engagement portion;

wherein in a state that the toner bottle and the print unit are coupled to each other, the elastic member is interposed between the print unit and the print unit engagement portion, between the toner bottle and the toner bottle engagement portion, or between the print unit engagement portion and the toner bottle engagement portion;

wherein the print unit and the print unit engagement portion are coupled to each other by a spring;

a flexible tube is provided inside the spring; and a supply port of the print unit engagement portion and an interior of the print unit are connected to each other by the tube.

* * * * *